US007569527B2

(12) United States Patent
Howell et al.

(10) Patent No.: US 7,569,527 B2
(45) Date of Patent: Aug. 4, 2009

(54) FLUORO DERIVATIVE-SUBSTITUTED ARYL PNICTOGENS AND THEIR OXIDES

(75) Inventors: John Lee Howell, Bear, DE (US); Kevin Anthony Hay, Langley, CA (US)

(73) Assignee: E.I. duPont de Nemours and Company, Wilmington, DE (US)

( * ) Notice: Subject to any disclaimer, the term of this patent is extended or adjusted under 35 U.S.C. 154(b) by 701 days.

(21) Appl. No.: 11/167,330

(22) Filed: Jun. 27, 2005

(65) Prior Publication Data

US 2006/0293195 A1 Dec. 28, 2006

(51) Int. Cl.
*C07C 15/24* (2006.01)

(52) U.S. Cl. ..... 508/588

(58) Field of Classification Search ..... 508/588
See application file for complete search history.

(56) References Cited

U.S. PATENT DOCUMENTS

| | | | | |
|---|---|---|---|---|
| 3,145,222 | A | 8/1964 | Brace | |
| 3,250,808 | A | 5/1966 | Moore et al. | |
| 3,293,306 | A | 12/1966 | LeBleu et al. | |
| 3,699,156 | A | 10/1972 | Holland et al. | |
| 4,011,267 | A * | 3/1977 | Tamborski et al. | 568/17 |
| 4,431,555 | A * | 2/1984 | Christian et al. | 508/182 |
| 4,431,556 | A * | 2/1984 | Christian et al. | 508/182 |
| 4,438,007 | A | 3/1984 | Snyder et al. | |
| 4,454,349 | A * | 6/1984 | Tamborski et al. | 568/13 |
| 4,681,693 | A | 7/1987 | Gavezotti et al. | |
| 4,965,379 | A | 10/1990 | Ikeda et al. | |
| 5,055,601 | A | 10/1991 | Ikeda et al. | |
| 5,097,090 | A | 3/1992 | Beck | |
| 5,376,289 | A | 12/1994 | Montagna et al. | |
| 5,493,049 | A | 2/1996 | Caporiccio | |
| 6,479,712 | B1 | 11/2002 | Kawa | |
| 6,573,410 | B2 | 6/2003 | Wlassics et al. | |
| 6,653,511 | B2 | 11/2003 | Howell et al. | |
| 2003/0027732 | A1 | 2/2003 | Howell et al. | |
| 2004/0176555 | A1 | 9/2004 | Guarda et al. | |

FOREIGN PATENT DOCUMENTS

| | | |
|---|---|---|
| EP | 0 100 488 A1 | 7/1983 |
| EP | 0 100 488 B1 | 7/1983 |

OTHER PUBLICATIONS

Jeanneaux et al.; Thermal Addition of Iodo-1-Perfluoroalkanes to the Perfluoroalkyl Ethylenes; Journal of Fluorine Chemistry, 4 261-70 (1974); Elsevier Sequoia S. A., Lausanne, Switzerland.

Brace; Some Approaches to the Synthesis of Fluorinated Alcohols and Esters. ii. Use of F-Alkyl Iodides for the Synthesis of F-Alkyl Alkanols; Journal of Fluorine Chemistry, 20 (1982) 313-327); Elsevier Sequoia S. A., The Netherlands.

Hajek et al.; Copper-Catalyzed Addition of Perfluoroalkyl Iodides to Unsaturated Alcohols and Transformation of the Addition Products; Journal of Fluorine Chemistry, 68 (1994) 49-56; Elsevier Sequoia S. A.

Brace et al.; Effect of a Perfluoroalkyl Group on the Elimination and Substitution Reactions of Two Homologous Series of Perfluoroalkyl-Substituted Iodoalkanes; J. Org. Chem. 1984, 49, 2361-2368; American Chemical Society.

Bravo et al.; New Methods of Free-Radical Perfluoroalkylation of Aromatics and Alkenes. Absolute Rate Constants and Partial Rate Factors for the Homolytic Aromatic Substitution By n-Perfluorobutyl Radical; J. Org. Chem. 1997, 62, 7128-7136; American Chemical Society.

* cited by examiner

*Primary Examiner*—Walter D Griffin
*Assistant Examiner*—Frank C Campanell
(74) *Attorney, Agent, or Firm*—Kathryn M. Sanchez

(57) ABSTRACT

Substituted aryl pnictogen derivative compositions having the structure of $$[R_f^1\text{-}(C_tR_{(u+v)})]_mE(O)_n(C_tR^1_{(u+v+1)})_{(3-m)}$$

wherein E is phosphorous, arsenic or antimony; $R_f^1$ is a fluoropolyether chain; $C_tR_{(u+v)}$ and $C_tR^1_{(u+v+1)}$ represent aryl groups, n is 0 or 1 and m is greater than about 0.5 to about 3. Such compositions have utility as additives for high temperature lubricants.

35 Claims, No Drawings

FLUORO DERIVATIVE-SUBSTITUTED ARYL PNICTOGENS AND THEIR OXIDES

BACKGROUND OF THE INVENTION

Due to their thermal stability, perfluoropolyether fluids have a great potential for use as engine oils, hydraulic fluids and greases. However, a drawback in their use results from the fact that certain metals are corroded by such fluids at temperatures of about 550° F. and above in an oxidative environment.

In U.S. Pat. No. 4,454,349, the preparation of perfluoroalkylether-substituted phenyl phosphines, having the structure of Formula 1 below, is described:

Formula 1

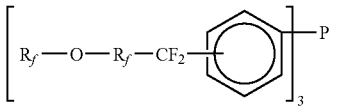

wherein $R_f$—O—$R_f$ is a perfluoroalkyl ether group containing at least one ether linkage. Examples of $R_f$—O—$R_f$ included:

$C_3F_7O[CF(CF_3)CF_2O]_xCF(CF_3)$-, $C_2F_5O(CF_2CF_2O)_yCF_2$-, and $CF_3O(CF_2O)_zCF_2$-, wherein x, y, and z are zero or an integer having a value of 1 to 20 and preferably 1 to 4.

Such phosphine derivatives are disclosed as being corrosion and oxidation inhibitors in polyfluoroalkylether polymeric fluids in long-term and wide temperature range applications. Temperature ranges are typically −100° F. to greater than 550° F., (−73° C. to greater than 288° C.). Incorporation of these compounds in perfluoroalkylether fluids inhibits the oxidation-corrosion of various metals with which the fluids come into contact. These additives also prevent decomposition of such fluids when exposed to a high-temperature oxidative environment.

The effectiveness of the perfluoroalkylether-, perfluoroalkyl-, or polyether-substituted phosphines as oxidation inhibitors in perfluoropolyether fluids is well known to those skilled in the art and has been described and quantified in several patents, for instance by Snyder, et al., in U.S. Pat. Nos. 4,438,006 and 4,438,007, and by Christian, et al., in U.S. Pat. Nos. 4,431,555, and 4,431,556.

However, the synthesis described in U.S. Pat. No. 4,454,349 involves multiple steps requiring the use of hazardous and pyrophoric reactants and reaction temperatures ranging between −80° C. and 200° C. The process includes two reaction steps requiring n-butyllithium and an intermediate sulfur tetrafluoride/hydrogen fluoride fluorination step. Consequently, such potentially useful perfluoroalkylether substituted phenyl phosphines have remained effectively inaccessible.

The mechanism of free-radical perfluoroalkylation of aromatics has been studied and discussed by Bravo et al., in *Journal of Organic Chemistry,* 62(21), 1997, pp. 7128-7136. Bravo et al. studied the reaction of a perfluoroalkyl iodide (such as perfluoro-n-butyl iodide) with various aromatic compounds, including benzene and biphenyl.

It would be desirable to have new compositions of fluoroalkylether-substituted aryl phosphines, arsines, and stibines. The present invention meets these needs.

SUMMARY OF THE INVENTION

The present invention provides new compositions of substituted aryl pnictogens and the corresponding oxides. The compositions have the general structure of Formula 2:

$$[R_f^1—(C_tR_{(u+v)})]_mE(O)_n(C_tR^1_{(u+v+1)})_{(3-m)} \quad \text{Formula 2}$$

wherein $R_f^1$ is a fluoropolyether chain having a formula weight ranging from about 400 to about 15,000, comprises repeat units, and is selected from the group consisting of:

(a) $J\text{-}O\text{-}(CF(CF_3)CF_2O)_c(CFXO)_dCFZ$-;

(b) $J^1\text{-}O\text{-}(CF_2CF_2O)_e(CF_2O)_fCFZ^1$-;

(c) $J^2\text{-}O\text{-}(CF(CF_3)CF_2O)_jCF(CF_3)CF_2$-;

(d) $J^3\text{-}O\text{-}(CQ_2\text{-}CF_2CF_2\text{-}O)_k\text{-}CQ_2\text{-}CF_2$-;

(e) $J^3\text{-}O\text{-}(CF(CF_3)CF_2O)_g(CF_2CF_2O)_h(CFXO)_i\text{-}CFZ$-;

(f) $J^4\text{-}O\text{-}(CF_2CF_2O)_rCF_2$-; and (h) combinations of two or more thereof wherein J is a fluoroalkyl group selected from the group consisting of $CF_3$, $C_2F_5$, $C_3F_7$, $CF_2Cl$, $C_2F_4Cl$, $C_3F_6Cl$, and combinations of two or more thereof;

c and d are numbers such that the ratio of c:d ranges from about 0.01 to about 0.5;

X is F, $CF_3$, or combinations thereof;

Z is F, Cl or $CF_3$;

$J^1$ is a fluoroalkyl group selected from the group consisting of $CF_3$, $C_2F_5$, $C_3F_7$, $CF_2Cl$, $C_2F_4Cl$, and combinations of two or more thereof;

e and f are numbers such that the ratio of e:f ranges from about 0.3 to about 5;

$Z^1$ is F or Cl;

$J^2$ is $C_2F_5$, $C_3F_7$, or combinations thereof;

j is an average number such that the formula weight of $R_f$ ranges from about 400 to about 15,000;

$J^3$ is selected from the group consisting of $CF_3$, $C_2F_5$, $C_3F_7$, and combinations of two or more thereof;

k is an average number such that the formula weight of $R_f$ ranges from about 400 to about 15,000;

each Q is independently F, Cl, or H;

g, h and i are numbers such that (g+h) ranges from about 1 to about 50, the ratio of i:(g+h) ranges from about 0.1 to about 0.5;

$J^4$ is $CF_3$, $C_2F_5$, or combinations thereof;

r is an average number such that the formula weight of $R_f$ ranges from about 400 to about 15,000; and each R and $R^1$ is independently H, a $C_1$-$C_{10}$ alkyl, a halogen, $OR^3$, OH, $SO_3M$, $NR^2_2$, $R^3OH$, $R^3SO_3M$, $R^3NR^2_2$, $R^3NO_2$, $R^3CN$, $C(O)OR^3$, C(O)OM, $C(O)R^3$, or $C(O)NR^2_2$, or combinations of two or more thereof;

wherein $R^2$ is independently H, $C_1$-$C_{10}$ alkyl, or combinations of two or more thereof;

$R^3$ is a $C_1$-$C_{10}$ alkyl; and

M is hydrogen or a metal, preferably not aluminum; more preferably, M is hydrogen or an alkali metal, still more preferably, M is hydrogen, sodium or potassium;

t is equal to (6+u);

u is any combination of 0, 2, 4, 6, 8, 10, 12, 14, 16;

v is independently either 2 or 4;

n is 0 or 1;

E is P, As, or Sb; and m is greater than about 0.5 to about 3, provided that, when E=P, m=3.0 and t=6, R cannot be exclusively H or contain F.

Preferably E is P. Preferably u is 0.

DETAILED DESCRIPTION

Trademarks and trade names used herein are shown in upper case.

A common characteristic of perfluoropolyethers is the presence of perfluoroalkyl ether moieties. Perfluoropolyether is synonymous to perfluoropolyalkylether. Thus, herein, fluoropolyether and fluoroalkylether are used interchangeably. Other synonymous terms frequently used include "PFPE", "PFPE oil", "PFPE fluid", and "PFPAE".

The term "pnictogens" collectively indicates the elements in the Periodic Table of Elements belonging to Group V. Herein the term "pnictogens" is constrained to indicate the subset P, As, and Sb, and "triaryl pnictogens" collectively refers to triaryl phosphines, triaryl arsines and triaryl stibines.

The present invention provides mono-, di-, and tri-substituted fluoropolyether derivatives of phosphine, arsine, and stibine. For example, these compounds have the structure of Formula 2:

$$[R_f^1\text{-}(C_tR_{(u+v)})]_mE(O)_n(C_tR^1_{(u+v+1)})_{(3-m)} \qquad \text{Formula 2}$$

wherein $R_f^1$ is a fluoropolyether chain. $R_f^1$ has a formula weight ranging from about 400 to about 15,000. $R_f^1$ comprises repeat units and $R_f^1$ is selected from the group consisting of:

(a) $J\text{-}O\text{-}(CF(CF_3)CF_2O)_c(CFXO)_dCFZ\text{-}$;

(b) $J^1\text{-}O\text{-}(CF_2CF_2O)_e(CF_2O)_fCFZ^1\text{-}$;

(c) $J^2\text{-}O\text{-}(CF(CF_3)CF_2O)_jCF(CF_3)CF_2\text{-}$;

(d) $J^3\text{-}O\text{-}(CQ_2\text{-}CF_2CF_2\text{-}O)_k\text{-}CQ_2\text{-}CF_2\text{-}$;

(e) $J^3\text{-}O\text{-}(CF(CF_3)CF_2O)_g(CF_2CF_2O)_h(CFXO)_i\text{-}CFZ\text{-}$;

(f) $J^4\text{-}O\text{-}(CF_2CF_2O)_rCF_2\text{-}$; and (h) combinations of two or more thereof wherein J is a fluoroalkyl group selected from the group consisting of $CF_3$, $C_2F_5$, $C_3F_7$, $CF_2Cl$, $C_2F_4Cl$, $C_3F_6Cl$, and combinations of two or more thereof;

c and d are numbers such that the ratio of c:d ranges from about 0.01 to about 0.5;

X is F, $CF_3$, or combinations thereof;

Z is F, Cl or $CF_3$;

$J^1$ is a fluoroalkyl group selected from the group consisting of $CF_3$, $C_2F_5$, $C_3F_7$, $CF_2Cl$, $C_2F_4Cl$, and combinations of two or more thereof;

e and f are numbers such that the ratio of e:f ranges from about 0.3 to about 5;

$Z^1$ is F or Cl;

$J^2$ is $C_2F_5$, $C_3F_7$, or combinations thereof;

j is an average number such that the formula weight of $R_f$ ranges from about 400 to about 15,000;

$J^3$ is selected from the group consisting of $CF_3$, $C_2F_5$, $C_3F_7$, and combinations of two or more thereof;

k is an average number such that the formula weight of $R_f$ ranges from about 400 to about 15,000;

each Q is independently F, Cl, or H;

g, h and i are numbers such that (g+h) ranges from about 1 to about 50, the ratio of i:(g+h) ranges from about 0.1 to about 0.5;

$J^4$ is $CF_3$, $C_2F_5$, or combinations thereof;

r is an average number such that the formula weight of $R_f$ ranges from about 400 to about 15,000; and each R and $R^1$ is independently H, a $C_1$-$C_{10}$ alkyl, a halogen, $OR^3$, OH, $SO_3M$, $NR^2_2$, $R^3OH$, $R^3SO_3M$, $R^3NR^2_2$, $R^3NO_2$, $R^3CN$, $C(O)OR^3$, C(O)OM, $C(O)R^3$, or $C(O)NR^2_2$, or combinations of two or more thereof;

wherein $R^2$ is independently H, $C_1$-$C_{10}$ alkyl, or combinations of two or more thereof;

$R^3$ is a $C_1$-$C_{10}$ alkyl; and

M is hydrogen or a metal, preferably not aluminum; more preferably, M is hydrogen or an alkali metal, still more preferably, M is hydrogen, sodium or potassium;

t is equal to (6+u);

u is any combination of 0, 2, 4, 6, 8, 10, 12, 14, 16;

v is independently either 2 or 4;

n is 0 or 1;

E is P, As, or Sb, preferably E is P; and m is greater than about 0.5 to about 3, provided that, when m=3.0 and t=6, R cannot be exclusively H or contain F.

In one particular embodiment, E is P and, in one alternative m is 1 and, in a second alternative m is 2.

Preferably $R_f^1$ is a fluoropolyether group selected from the group consisting of:

$F(C_3F_6O)_zCF(CF_3)CF_2\text{-}$;

$F(C_3F_6O)_x(CF_2O)_wCF_2\text{-}$;

$F(C_3F_6O)_x(C_2F_4O)_q(CF_2O)_wCF_2\text{-}$;

$(R_f^3)_2CFO(C_3F_6O)_xCF(CF_3)CF_2\text{-}$; and combinations of two or more thereof;

wherein x is a number from 2 to about 100;

z is a number from about 3 to about 50;

q is a number from 2 to about 50;

w is a number from 2 to about 50;

each $R_f^3$ can be the same or different and is independently a monovalent $C_1$ to $C_{20}$ branched or linear fluoroalkane; and $C_3F_6O$ is linear or branched.

More preferably, $R_f^1$ is a fluoropolyether group selected from the group consisting of $F(C_3F_6O)_zCF(CF_3)CF_2\text{-}$; $(R_f^3)_2CFO(C_3F_6O)_xCF(CF_3)CF_2\text{-}$; and combinations thereof, wherein x is a number from 2 to about 100;

z is a number from about 3 to about 50;

each $R_f^3$ can be the same or different and is independently a monovalent $C_1$ to $C_{20}$ branched or linear fluoroalkane; and $C_3F_6O$ is linear or branched.

There is also a process to prepare the compositions of this invention which comprises a first step comprising contacting a fluoropolyether primary bromide or fluoropolyether primary iodide with a triaryl derivative of phosphorus (triaryl phosphine or triaryl phosphine oxide), arsenic (triarylarsine or triarylarsine oxide), or antimony (triarylstibine or triarylstibine oxide). Preferably a fluoropolyether primary bromide or iodide is contacted with a triaryl phosphine or triaryl phosphine oxide. Said contacting step is optionally performed in the presence of one or more of a radical initiator, a solvent, and a catalyst, to produce a corresponding fluoropolyether-substituted aryl phosphine oxide, fluoropolyether-substituted aryl arsine oxide, or fluoropolyether-substituted aryl stibine oxide. Optionally, the process of the present invention further comprises contacting the fluoropolyether-substituted aryl phosphine oxide, arsine oxide, or stibine oxide with a reducing agent to form a fluoropolyether-substituted aryl phosphine, fluoropolyether-substituted aryl arsine, or fluoropolyether-substituted aryl stibine.

Fluoropolyether primary bromides or iodides useful in the first step to prepare compositions of this invention include, but are not limited to, those having the formulae of:

$F(C_3F_6O)_zCF(CF_3)CF_2Y$;

$F(C_3F_6O)_x(CF_2O)_wCF_2Y$;

$F(C_3F_6O)_x(C_2F_4O)_q(CF_2O)_wCF_2Y$;

$(R_f^3)_2CFO(C_3F_6O)_xCF(CF_3)CF_2Y$;
$F(C_pF_{2p})Y$;

and combinations of two or more thereof;

wherein Y is Br or I; and x, z, q, w, p, $R_f^3$, and $C_3F_6O$ are as described above for preferred $R_f^1$ fluoropolyether group.

A preferred perfluoropolyether bromide or iodide useful to prepare the compositions of this invention has the formula $F(C_3F_6O)_zCF(CF_3)CF_2Y$ where Y and z are defined above.

Triaryl phosphines, triaryl arsines, and triaryl stibines and the oxides thereof useful in the first step of a process to prepare the pnictogen compositions of this invention include, but are not limited to, compounds having the structure of Formula 3:

$$(C_tR_{(u+v+1)})_mE(O)_n(C_tR^1_{(u+v+1)})_{(3-m)} \quad \text{Formula 3}$$

wherein

E, R, $R^1$, t, u, v, m, and n are the same as defined for Formula 2, above.

Preferably, E is P.

Preferred starting materials for the compositions of this invention are the triaryl phosphines, arsines and stibines; more preferred are triaryl phosphines, still more preferred is triphenyl phosphine or triphenyl phosphine oxide.

Suitable radical initiators for use in the first step include, but are not limited to, peroxides such as benzoyl peroxide and t-butyl peroxide. When used, a radical initiator is preferably added in two or more portions.

Suitable solvents include liquid aliphatic alcohols and carboxylic acids, preferably carboxylic acids, and more preferably, glacial acetic acid.

Suitable catalysts include any compound that promotes the formation of a fluoropolyether free radical. Cupric acetate, ferric acetate, ferric chloride or combinations of two or more thereof are examples of suitable catalysts. Cupric acetate is preferred. When used, the catalyst is typically present in an amount in the range of from about 0.0001 to about 5 weight %, based on the weight of the primary bromide or iodide compound.

The first step reaction is conducted at a temperature in the range of about 50° C. to about 210° C., preferably between about 70° to about 110° C. The reaction product is typically washed with a suitable organic solvent, for example, a 1:1 acetone:water mixture or glacial acetic acid, filtered, and stripped of volatile byproducts by distillation under reduced pressure to yield the fluoropolyether-substituted aryl phosphine oxide, fluoropolyether-substituted aryl arsine oxide, or fluoropolyether-substituted aryl stibine oxide.

The optional second step of the process of the present invention comprises contacting, in an inert solvent such as diethyl ether, the fluoropolyether-substituted aryl phosphine oxide, aryl arsine oxide or aryl stibine oxide with a reducing agent at a temperature from about 0° C. to about 12° C., preferably about 4° C. Lithium aluminum hydride, $LiAlH_4$ may be conveniently used. Optionally, prior to adding the reducing agent, the oxide may be contacted with an alkyl iodide such as methyl iodide, at ambient temperature, such as at about 25° C. This step may further comprise hydrolyzing the excess reducing agent, for example, $LiAlH_4$, with water or dilute hydrochloric acid, (for example, 2M HCl). This step may also further comprise washing the product with water and dilute HCl, and vacuum distilling the washed product. An inert fluorinated solvent is optionally used to aid transfer. Suitable inert fluorinated solvents are 1,1,2-trichlorotrifluoroethane or methyl perfluorobutyl ether (HFE-7100, available from 3M Corp., St. Paul, Minn.). This step may still further optionally comprise dissolving the distilled product in the same or a different inert fluorinated solvent, filtering, and redistilling under vacuum, to remove volatiles to yield the product phosphine, arsine or stibine.

While not wishing to be bound by theory, it is believed that the fluoroalkylether-substitution occurs on the aryl substituent through a free radical mechanism similar to that described by Bravo et al. in *Journal of Organic Chemistry,* 62(21), 1997, pp. 7128-7136.

End Uses

The fluoropolyether-substituted aryl phosphines and phosphine oxides, fluoropolyether-substituted aryl arsines and arsine oxides, and fluoropolyether-substituted aryl stibines and stibine oxides of this invention are useful as additives to perfluoropolyether lubricants (oils and greases) for lubrication purposes under extreme temperature conditions, such as in military applications. Thus, the present invention further provides a perfluoropolyether lubricant comprising a fluoropolyether-substituted aryl phosphine or phosphine oxide, fluoropolyether-substituted aryl arsine or arsine oxide, or fluoropolyether-substituted aryl stibine. In practice, the fluoropolyether-substituted aryl phosphines, arsines, or stibines or the oxides of the present invention are added to perfluoropolyether lubricants in amounts of about 0.1 to about 5% by weight based on the weight of the perfluoropolyether lubricant, and preferably about 1 to about 2% by weight.

The fluoropolyether-substituted phosphines of this invention are useful as fluorous phase catalysts in hydroformylation reactions.

Materials and Test Methods

HFE-7100, methyl perfluorobutyl ether, is available from 3M Corp., St. Paul, Minn.

KRYTOX Iodide $[F(C_3F_6O)_zCF(CF_3)CF_2I$ where z has an average value of about 4-5] is produced by the methods described in U.S. Pat. No. 6,653,511, incorporated herein by reference.

Triaryl phosphines, stibines, and their derivatives are available from Sigma-Aldrich Chemical, Milwaukee, Wis.

CELITE 521 is a diatomaceous earth filter aid available from Sigma-Aldrich Chemical, Milwaukee, Wis.

EXAMPLES

Example 1

Preparation of $[F(CF(CF_3)CF_2O)_zCF(CF_3)CF_2—C_6H_4][C_6H_5]_2P{=}O$

A flask is charged with $F(CF(CF_3)CF_2O)_zCF(CF_3)CF_2I$ (50 g, 43 mmol, $z_{avg}$=5.43), glacial acetic acid (500 mL), and triphenylphosphine (67.77 g, 280 mmol). The reaction mass is stirred and heated to 70° C., then benzoyl peroxide (10 g) is added, and the temperature raised to 90° C. Five more additions of benzoyl peroxide (each 10 g) are made in 1.5-hour intervals, for a total of 60 g. When GC/MS analysis indicates all the iodide was reacted, the crude product is then washed three times with 200 mL of 1:1 water:acetone solution and purified by oil pump vacuum (1 mmHg, 130 Pa) distillation at 120° C. The sample is then filtered through a CELITE 521 bed as in Example 1. Further purification by distillation at 220° C. using a molecular drag pump (0.1 mmHg, 13 Pa) eliminates poly-HFPO byproducts, yielding purified $[F(CF(CF_3)CF_2O)_zCF(CF_3)CF_2—C_6H_4][C_6H_5]_2P{=}O$, as evidenced by $^1H$, $^{19}F$, and $^{31}P$ NMR and semi-quantitative XRF (P=2.67±0.08%) (19.55 g, 30.5%).

Example 2

Reduction of $[F(CF(CF_3)CF_2O)_zCF(CF_3)CF_2—C_6H_4][C_6H_5]_2P═O$

To $[F(CF(CF_3)CF_2O)_zCF(CF_3)CF_2—C_6H_4][C_6H_5]_2P═O$ (10.7 g, 7.2 mmol, $z_{avg}$=5.29 prepared as in Example 1) is added anhydrous diethyl ether (12 mL) at room temperature with stirring. Methyl iodide (0.577 mL, 9.4 mmol) is then added and the mixture stirred for 2 hours. The reaction vessel is then cooled to 4° C. using an ice water bath, and a 1M $LiAlH_4$ solution in diethyl ether (21.5 mL, 21.5 mmol) is slowly added using an addition funnel. After stirring for 4 hours at 4° C., the excess $LiAlH_4$ is hydrolyzed using 40 mL of water. The aqueous layer is drawn off, and the mixture is then subsequently washed with 40 mL water, then twice with 40-mL portions of 5% HCl. HFE-7100 (20 mL) is then added to aid transfer to a distilling flask. The crude product is distilled at 100° C. with oil pump vacuum (1 mmHg, 130 Pa). The product is then re-dissolved in HFE-7100 (20 mL) and filtered in a Büchner funnel through WHATMAN #1 filter paper to eliminate solid impurities. The product is re-distilled at 115° C. with oil pump vacuum (1 mmHg, 130 Pa) for 2 h, yielding $[F(CF(CF_3)CF_2O)_zCF(CF_3)CF_2—C_6H_4][C_6H_5]_2P═O$, as evidenced by $^1H$, $^{19}F$, and $^{31}P$ NMR, and semi-quantitative XRF (P=3.50±0.09%) (7.44 g, 69.5%).

Example 3

Preparation of $[F(CF(CF_3)CF_2O)_zCF(CF_3)CF_2—C_6H_4]_3Sb═O$

A flask is charged with $F(CF(CF_3)CF_2O)_zCF(CF_3)CF_2I$ (50 g, 42 mmol, $z_{avg}$=4.27), glacial acetic acid (50 mL), Copper(II) acetate (0.15 g, 0.8 mmol), and triphenylantimony (4.77 g, 13.5 mmol). The reaction mass is stirred and heated to 70° C., then benzoyl peroxide (5 g) is added, and the temperature raised to 90° C. Five more additions of benzoyl peroxide (each 5 g) are made in 1.5-hour intervals, for a total of 30 g. When GC/MS analysis indicates all the iodide is reacted, the crude product is then washed three times with 100 mL of 1:1 water:acetone solution and purified by oil pump vacuum (1 mmHg, 130 Pa) distillation at 120° C. The sample is then filtered through a Büchner funnel with a 0.25 inch (6.4 mm) layer of CELITE 521 (see MATERIALS) on a WHATMAN #1 filter paper, yielding 29.1 g (64.5%). Further purification by distillation at 220° C. using a molecular drag pump (0.1 mmHg, 13 Pa) eliminates poly-HFPO byproducts, yielding purified $[F(CF(CF_3)CF_2O)_zCF(CF_3)CF_2—C_6H_4]_3Sb═O$, as evidenced by $^1H$, $^{19}F$, and $^{31}P$ NMR, and semi-quantitative XRF (Sb=3.02±0.20%) (13.52 g, 29.9%).

Example 4

Reduction of $[F(CF(CF_3)CF_2O)_zCF(CF_3)CF_2—C_6H_4]_3Sb═O$

To $[F(CF(CF_3)CF_2O)_zCF(CF_3)CF_2—C_6H_4]_3Sb═O$ (5.0 g, 7.2 mmol, $z_{avg}$=5.29 prepared as in Example 3) is added anhydrous diethyl ether (5 mL) at room temperature with stirring. Methyl iodide (0.10 mL, 1.63 mmol) is then added and the mixture stirred for 3 hours. The reaction vessel is then cooled to 4° C. using an ice water bath, and a 1M $LiAlH_4$ solution in diethyl ether (3.4 mL, 3.4 mmol) is slowly added using an addition funnel. After stirring for 4 hours at 4° C., the excess $LiAlH_4$ is hydrolyzed using 20 mL of water. The aqueous layer is drawn off, and the mixture is then subsequently washed twice with 50 mL of 5% HCl. HFE-7100 (10 mL) is then added to aid transfer to a distilling flask. The product is distilled at 115° C. with oil pump vacuum (1 mmHg, 0.13 kPa), yielding $[F(CF(CF_3)CF_2O)_zCF(CF_3)CF_2—C_6H_4]_3Sb$, as evidenced by $^1H$ and $^{19}F$ NMR, and semi-quantitative XRF (Sb=1.07±0.08%) (3.67 g, 73.4%).

Example 5

Preparation of $[F(CF(CF_3)CF_2O)_zCF(CF_3)CF_2—C_6H_3(ortho\text{-}CH_3)]_3P═O$ A flask is charged with $F(CF(CF_3)CF_2O)_zCF(CF_3)CF_2I$ (50 g, 42 mmol, $z_{avg}$=4.3), glacial acetic acid (50 mL), copper (II) acetate (0.15 g, 0.8 mmol), and tri-ortho-tolylphosphine (4.10 g, 13.5 mmol). The reaction mass is stirred and heated to 70° C., then benzoyl peroxide (5 g) is added, and the temperature raised to 90° C. Two more additions of benzoyl peroxide (each 5 g) are made in 1.5-hour intervals, for a total of 15 g. When GC/MS analysis indicates all the iodide is reacted, the crude product is then washed three times with 100 mL of 1:1 water:acetone solution and purified by oil pump vacuum distillation (1 mmHg, 130 Pa) at 120° C. The sample is then filtered through a Büchner funnel with a 0.25 inch (6.4 mm) layer of CELITE 521 (see MATERIALS) on a WHATMAN #1 filter paper, yielding 19.18 g (43.1%). Further purification by distillation at 220° C. using a molecular drag pump (0.1 mmHg, 130 Pa) eliminates poly-HFPO byproducts, yielding purified $[F(CF(CF_3)CF_2O)_zCF(CF_3)CF_2C_6H_3(ortho\text{-}CH_3)]_3P═O$, as evidenced by $^1H$, $^{19}F$, and $^{31}P$ NMR, and semi-quantitative XRF (P=1.37±0.06%) (9.75 g, 21.9%).

Example 6

Preparation of $[F(CF(CF_3)CF_2O)_zCF(CF_3)CF_2—C_6H_3(ortho\text{-}CH_3)][F(CF(CF_3)CF_2O)_zCF(CF_3)CF_2—C_6H_4]_2P═O$ A flask is charged with $F(CF(CF_3)CF_2O)_zCF(CF_3)CF_2I$ (50 g, 42 mmol, $z_{avg}$=4.27), glacial acetic acid (50 mL), and diphenyl(ortho-tolyl)phosphine (3.87 g, 14 mmol). The reaction mass was stirred and heated to 70° C., then benzoyl peroxide (5 g) was added, and the temperature was raised to 90° C. Two more additions of benzoyl peroxide (each 5 g) were made in 1.5-hour intervals, for a total of 15 g. When GC/MS analysis indicated all the iodide was reacted, the crude product was then washed twice with 40 mL of glacial acetic acid. The glacial acetic acid washes were then extracted with 30 mL HFE-7100, the extracts added to the product layer, and purified by oil pump vacuum (1 mmHg, 0.13 kPa) distillation at 120° C. Further purification by distillation at 220° C. using a molecular drag pump (0.1 mmHg, 0.013 kPa) was effected to eliminate poly-HFPO byproducts, yielding purified $[F(CF(CF_3)CF_2O)_zCF(CF_3)CF_2—C_6H_3(ortho\text{-}CH_3)][F(CF(CF_3)CF_2O)_zCF(CF_3)CF_2—C_6H_4]_2P═O$, as evidenced by $^1H$, $^{19}F$, and $^{31}P$ NMR, and semi-quantitative XRF (P=1.36±0.06%) (21.02 g, 42.0%).

What is claimed is:

1. A substituted aryl pnictogen composition having the structure of:

$$[R_f^1\text{-}(C_tR_{(u+v)})]_mE(O)_n(C_tR^1_{(u+v+1)})_{(3-m)}$$

wherein $R_f^1$ is a fluoropolyether chain having a formula weight ranging from about 400 to about 15,000, comprises repeat units, and is selected from the group consisting of:

(a) $J\text{-}O\text{-}(CF(CF_3)CF_2O)_c(CFXO)_dCFZ\text{-}$;

(b) $J^1\text{-}O\text{-}(CF_2CF_2O)_e(CF_2O)_fCFZ^1\text{-}$;

(c) $J^2\text{-}O\text{-}(CF(CF_3)CF_2O)_jCF(CF_3)CF_2\text{-}$;

(d) $J^3$-O-$(CQ_2$-$CF_2CF_2$-O$)_k$-$CQ_2$-$CF_2$-;

(e) $J^3$-O-$(CF(CF_3)CF_2O)_g(CF_2CF_2O)_h(CFXO)_i$-CFZ-;

(f) $J^4$-O-$(CF_2CF_2O)_rCF_2$-; and (h) combinations of two or more thereof wherein J is a fluoroalkyl group selected from the group consisting of $CF_3$, $C_2F_5$, $C_3F_7$, $CF_2Cl$, $C_2F_4Cl$, $C_3F_6Cl$, and combinations of two or more thereof;

c and d are numbers such that the ratio of c:d ranges from about 0.01 to about 0.5;

X is F, $CF_3$, or combinations thereof;

Z is F, Cl or $CF_3$;

$J^1$ is a fluoroalkyl group selected from the group consisting of $CF_3$, $C_2F_5$, $C_3F_7$, $CF_2Cl$, $C_2F_4Cl$, and combinations of two or more thereof;

e and f are numbers such that the ratio of e:f ranges from about 0.3 to about 5;

$Z^1$ is F or Cl;

$J^2$ is $C_2F_5$, $C_3F_7$, or combinations thereof;

j is an average number such that the formula weight of $R_f$ ranges from about 400 to about 15,000;

$J^3$ is selected from the group consisting of $CF_3$, $C_2F_5$, $C_3F_7$, and combinations of two or more thereof;

k is an average number such that the formula weight of $R_f$ ranges from about 400 to about 15,000;

each Q is independently F, Cl, or H;

g, h and i are numbers such that (g+h) ranges from about 1 to about 50, the ratio of i:(g+h) ranges from about 0.1 to about 0.5;

$J^4$ is $CF_3$, $C_2F_5$, or combinations thereof;

r is an average number such that the formula weight of $R_f$ ranges from about 400 to about 15,000; and each R and $R^1$ is independently H, a $C_1$-$C_{10}$ alkyl, a halogen, $OR^3$, OH, $SO_3M$, $NR^2_2$, $R^3OH$, $R^3SO_3M$, $R^3NR^2_2$, $R^3NO_2$, $R^3CN$, $C(O)OR^3$, C(O)OM, $C(O)R^3$, or $C(O)NR^2_2$, or combinations of two or more thereof;

wherein $R^2$ is independently H, $C_1$-$C_{10}$ alkyl, or combinations of two or more thereof;

$R^3$ is a $C_1$-$C_{10}$ alkyl; and

M is hydrogen or a metal;

t is equal to (6+u);

u is any combination of 0, 2, 4, 6, 8, 10, 12, 14, 16;

v is independently either 2 or 4;

n is 0 or 1;

E is P, As, or Sb; and m is greater than about 0.5 to about 3, provided that, when E=P, m=3.0 and t=6, R cannot be exclusively H or contain F.

2. The composition of claim 1 wherein $R_f^1$ is selected from the group consisting of:

$F(C_3F_6O)_zCF(CF_3)CF_2$-;

$F(C_3F_6O)_x(CF_2O)_wCF_2$-;

$F(C_3F_6O)_x(C_2F_4O)_q(CF_2O)_wCF_2$-;

$(R_f^3)_2CFO(C_3F_6O)_xCF(CF_3)CF_2$-; and combinations of two or more thereof;

wherein x is a number from 2 to about 100;

z is a number from about 3 to about 50;

q is a number from 2 to about 50;

w is a number from 2 to about 50;

each $R_f^3$ can be the same or different and is independently a monovalent $C_1$ to $C_{20}$ branched or linear fluoroalkane; and $C_3F_6O$ is linear or branched.

3. The composition of claim 2 wherein $R_f^1$ is selected from the group consisting of: $F(C_3F_6O)_zCF(CF_3)CF_2$-; $(R_f^3)_2CFO(C_3F_6O)_xCF(CF_3)CF_2$-; and combinations thereof.

4. The composition of claim 3 wherein $R_f^1$ is $F(CF(CF_3)CF_2O)_zCF(CF_3)CF_2$-.

5. The composition of claim 1 wherein n is 0.

6. The composition of claim 1 wherein n is 1.

7. The composition of claim 1 wherein E is P.

8. The composition of claim 1 wherein E is P and m is 1 or 2.

9. The composition of claim 8 wherein m is 1.

10. The composition of claim 8 wherein m is 2.

11. The composition of claim 8 wherein n is 0.

12. The composition of claim 8 wherein n is 1.

13. The composition of claim 2 wherein E is P and m is 1 or 2.

14. The composition of claim 13 wherein m is 1.

15. The composition of claim 13 wherein m is 2.

16. The composition of claim 13 wherein n is 0.

17. The composition of claim 13 wherein n is 1.

18. The composition of claim 3 wherein E is P and m is 1 or 2.

19. The composition of claim 18 wherein m is 1.

20. The composition of claim 18 wherein m is 2.

21. The composition of claim 18 wherein n is 0.

22. The composition of claim 18 wherein n is 1.

23. The composition of claim 4 wherein E is P and m is 1 or 2.

24. The composition of claim 23 wherein m is 1.

25. The composition of claim 23 wherein m is 2.

26. The composition of claim 23 wherein n is 0.

27. The composition of claim 23 wherein n is 1.

28. A perfluoropolyether lubricant comprising the composition of claim 1 wherein the composition is present in an amount of about 0.1 to about 5% by weight based on the weight of the perfluoropolyether lubricant.

29. The lubricant of claim 28 wherein composition is present in an amount of about 1 to about 2% by weight based on the weight of the perfluoropolyether lubricant.

30. A perfluoropolyether lubricant comprising the composition of claim 2 wherein the composition is present in an amount of about 0.1 to about 5% by weight based on the weight of the perfluoropolyether lubricant.

31. The lubricant of claim 30 wherein the composition is present in an amount of about 1 to about 2% by weight based on the weight of the perfluoropolyether lubricant.

32. A perfluoropolyether lubricant comprising the composition of claim 3 wherein the composition is present in an amount of about 0.1 to about 5% by weight based on the weight of the perfluoropolyether lubricant.

33. The lubricant of claim 32 wherein the composition is present in an amount of about 1 to about 2% by weight based on the weight of the perfluoropolyether lubricant.

34. A perfluoropolyether lubricant comprising the composition of claim 4 wherein the composition is present in an amount of about 0.1 to about 5% by weight based on the weight of the perfluoropolyether lubricant.

35. The lubricant of claim 34 wherein the composition is present in an amount of about 1 to about 2% by weight based on the weight of the perfluoropolyether lubricant.

* * * * *